US006876375B2

(12) United States Patent
Taki et al.

(10) Patent No.: US 6,876,375 B2
(45) Date of Patent: Apr. 5, 2005

(54) COLOR THERMAL PRINTER HAVING A LIGHT SOURCE

(75) Inventors: Tomoko Taki, Saitama (JP); Hideyuki Kokubo, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 58 days.

(21) Appl. No.: 10/360,728

(22) Filed: Feb. 10, 2003

(65) Prior Publication Data

US 2003/0151655 A1 Aug. 14, 2003

(30) Foreign Application Priority Data

Feb. 12, 2002 (JP) ..... 2002-033447

(51) Int. Cl.[7] ..... B41J 2/315; B41J 2/325
(52) U.S. Cl. ..... 347/175; 347/212
(58) Field of Search ..... 347/172, 175, 347/212, 174, 218, 238; 349/210, 21; 399/154; 400/120.03, 120.02, 120.04, 120.18

(56) References Cited

U.S. PATENT DOCUMENTS 6,084,624 A * 7/2000 Yamakawa ..... 347/175
6,429,888 B1 * 8/2002 Taki et al. ..... 347/223

FOREIGN PATENT DOCUMENTS

JP 5-38823 2/1993

* cited by examiner

*Primary Examiner*—K. Feggins
(74) *Attorney, Agent, or Firm*—Sughrue Mion, PLLC

(57) ABSTRACT

A flat-type fluorescent lamp is used as a light source of a color thermal printer. The flat-type fluorescent lamp has a yellow luminescent surface for emitting yellow fixing rays, and a magenta luminescent surface for emitting magenta fixing rays. The respective luminescent surfaces are disposed back to back and are selectively activated by a lamp driving circuit. The flat-type fluorescent lamp is rotatable between a first position where the yellow luminescent surface confronts a recording surface of a color thermosensitive recording paper, and a second position where the magenta luminescent surface confront the recording surface of the recording paper.

17 Claims, 3 Drawing Sheets

COLOR THERMAL PRINTER HAVING A LIGHT SOURCE

BACKGROUND OF THE INVENTION

1. Field of the Invention

The present invention relates to a color thermal printer having a light source.

2. Description of the Related Art

A color thermal printer for printing a full-color image is known. Such a color thermal printer uses a color thermosensitive recording paper in which at least three kinds of thermosensitive coloring layers are stacked on a base in order. For instance, the thermosensitive coloring layers include a cyan thermosensitive coloring layer, a magenta thermosensitive coloring layer, and a yellow thermosensitive coloring layer. The respective coloring layers are stacked in an order of yellow, magenta and cyan from the uppermost layer. Thermal sensitivity of the thermosensitive coloring layer becomes lower as a position thereof is lower.

The yellow thermosensitive coloring layer and the magenta thermosensitive coloring layer positioned thereunder are respectively possessed of a fixing property caused by rays of a specific wavelength band. The yellow thermosensitive coloring layer is optically fixed by applying yellow fixing rays which are violaceous rays having a wavelength of about 420 nm. Meanwhile, the magenta thermosensitive coloring layer is optically fixed by applying magenta fixing rays which are near ultraviolet rays having a wavelength of about 365 nm.

For example, as a light source for fixation, are used two fluorescent lamps of a straight-tube type constituted of a yellow fluorescent lamp and a magenta fluorescent lamp. The yellow fluorescent lamp includes a fluorescent material for emitting yellow fixing rays, and the magenta fluorescent lamp includes another fluorescent material for emitting magenta fixing rays. The yellow and magenta fluorescent lamps are arranged side by side above a conveyance passage. Further, a reflector is disposed around the respective fluorescent lamps.

When a couple of the fluorescent lamps are arranged side by side, it is difficult to downsize the printer. On account of this, in a color thermal printer described in Japanese Patent Laid-Open Publication No. 5-038823, the fixing rays are adapted to be emitted such that two kinds of fluorescent materials for emitting the respective fixing rays of yellow and magenta are separately spread on an inner wall of a glass tube of a single fluorescent lamp. This fluorescent lamp simultaneously emits the yellow and magenta fixing rays. Thus, a light shielding filter is provided to prevent the magenta fixing rays, which are emitted from the magenta fluorescent material, from being applied to a color thermosensitive recording paper during yellow fixation.

However, in order to securely shield the light, it is necessary to enlarge a size of the light shielding filter or to increase a number thereof. In doing so, there arises a problem in that it is difficult to downsize a body of the printer.

SUMMARY OF THE INVENTION

In view of the foregoing, it is a primary object of the present invention to provide a color thermal printer having a small size.

It is a second object of the present invention to provide a color thermal printer having a light source in which two luminescent surfaces are disposed on different planes.

In order to achieve the above and other objects, the color thermal printer according to the present invention comprises a flat light source having first and second luminescent surfaces, which are disposed on different planes and emit rays having difference wavelengths. The respective luminescent surfaces are selectively activated to emit the rays. The color thermal printer further comprises a mechanism for rotating the flat light source to selectively confront the respective luminescent surfaces with a recording surface of a color thermosensitive recording paper.

The color thermal printer uses the recording paper in which a plurality of thermosensitive coloring layers for coloring in different colors are stacked on a base in order. The thermosensitive coloring layer for which thermal recording has been performed is optically fixed by applying the rays specific to each of the thermosensitive coloring layers.

In a preferred embodiment, the flat light source is a flat-type fluorescent lamp comprising a first anode panel, a second anode panel, a filament, a first grid electrode, and a second grid electrode. The first and second anode panels constitute the first and second luminescent surfaces respectively. On the anode panels, are applied first and second fluorescent materials respectively. These fluorescent materials are excited by electron beams radiated from the filament to emit the rays having the different wavelengths. The first and second grid electrodes are disposed between the filament and the respective anode panels to control the electron beam. It is preferable to dispose the first and second luminescent surfaces back to back.

The color thermal printer according to the present invention comprises the flat light source and the light-source rotating mechanism so that it is possible to downsize a body of the printer.

BRIEF DESCRIPTION OF THE DRAWINGS

The above objects and advantages of the present invention will become apparent from the following detailed description of the preferred embodiments of the invention when read in conjunction with the accompanying drawings, in which.

DETAILED DESCRIPTION OF THE PREFERRED EMBODIMENT(S)

Figure 1:
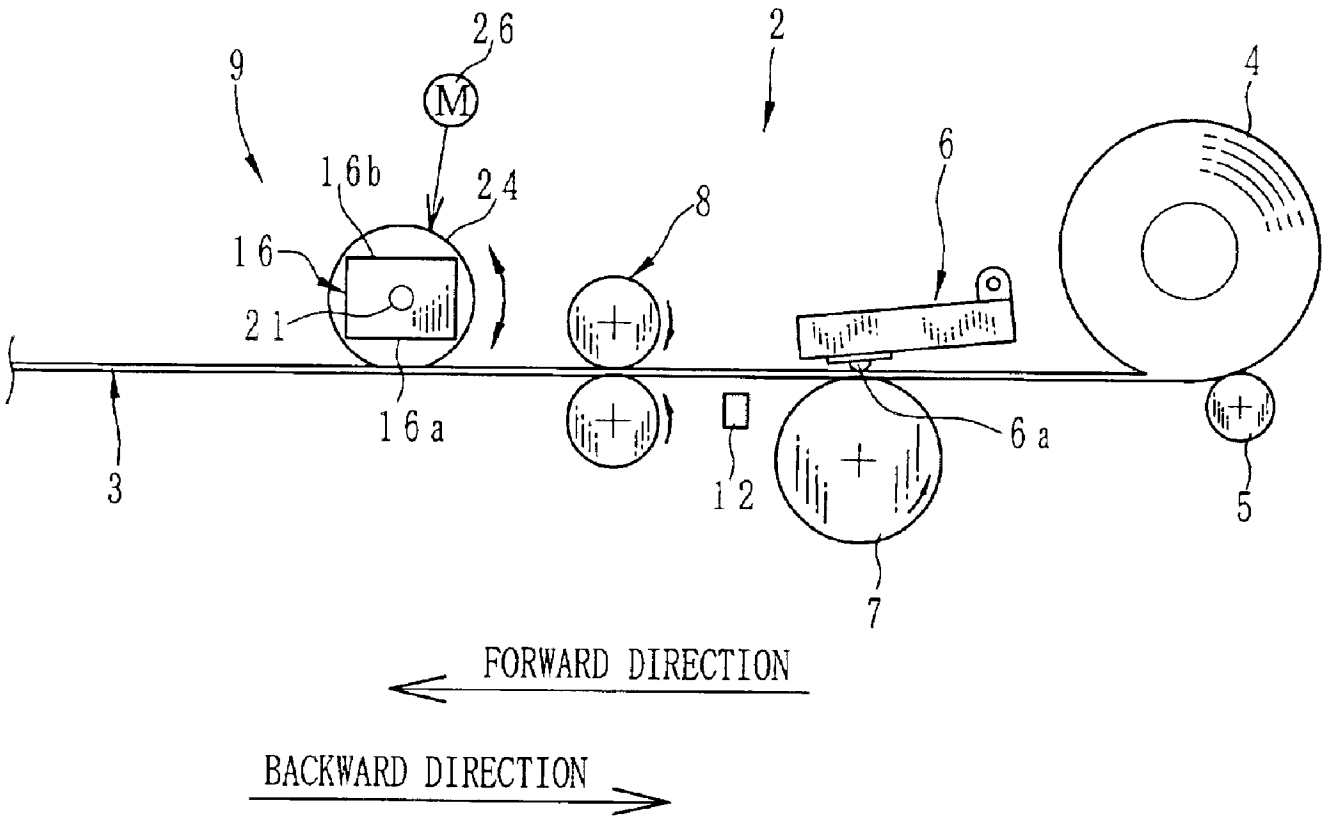
FIG. 1 is a schematic illustration showing a color thermal printer.

A color thermal printer 2 shown in FIG. 1 thermally records a full-color image on a color thermosensitive recording paper 3 and optically fixes the recording paper 3, for which thermal recording is already performed, while the recording paper 3 is reciprocated in forward and backward directions.

The color thermosensitive recording paper 3 comprises at least three thermosensitive coloring layers stacked on a base. These coloring layers are a yellow thermosensitive coloring layer, a magenta thermosensitive coloring layer and a cyan thermosensitive coloring layer, which color in yellow, magenta and cyan respectively. The thermosensitive coloring layers are stacked in an order of yellow, magenta and cyan from the uppermost layer. Thermal sensitivity of the thermosensitive coloring layer becomes lower as its position is lower.

The yellow thermosensitive coloring layer and the magenta thermosensitive coloring layer positioned thereunder are respectively possessed of a fixing property caused by rays of a specific wavelength band. The yellow thermosensitive coloring layer is optically fixed by applying yellow fixing rays having a wavelength of about 420 nm. Meanwhile, the magenta thermosensitive coloring layer is optically fixed by applying magenta fixing rays having a wavelength of about 365 nm.

In the color thermal printer 2, is set a recording paper roll 4 formed by winding the color thermosensitive recording paper 3 in a roll state. The recording paper roll 4 is rotated by a paper feeding roller 5 to feed the recording paper 3 on a conveyance passage.

At the conveyance passage, a thermal head 6 and a platen roller 7 are disposed. The platen roller 7 confronts the thermal head 6 to support the color thermosensitive recording paper 3. As well known, the thermal head 6 comprises a heating element array 6*a* in which a large number of heating elements are aligned in a scanning direction. The heating element array 6*a* is pressed against the recording paper 3 to perform thermal recording. The respective heating elements generate thermal energy in accordance with a density of a pixel to thermally record color images of yellow, magenta and cyan on the respective thermosensitive coloring layers.

A conveyance roller pair 8 and an optical fixing unit 9 are disposed at a downstream side of the thermal head 6 in the forward direction. The conveyance roller pair 8 nips the fed recording paper 3 to convey it in a feeding direction.

The color thermal recording paper 3 passes the thermal head 6 and the optical fixing unit 9 during the conveyance thereof to perform the thermal recording and the optical fixation. After completing the thermal recording and the optical fixation, the recording paper 3 is cut into a sheet of a predetermined size by a cutter, which is not shown. Then, the recording paper 3 is discharged to the outside of the color thermal printer 2.

As a motor used for conveyance, a pulse motor is employed. The pulse motor rotates by a predetermined angle in accordance with a number of supplied drive pulses. When a photosensor 12 detects a leading edge of the recording paper 3 at the time of paper feed, counting the drive pulse is started. By counting the drive pulse upward and downward, a conveyance amount is controlled in the forward and backward directions.

The optical fixing unit 9 utilizes a flat-type fluorescent lamp 16 as a light source in which a fluorescent material is excited by an electron beam to emit the light. Since the flat-type fluorescent lamp 16 has a flat luminescent surface, luminous intensity distribution is good in comparison with a fluorescent lamp of a straight-tube type. The flat-type fluorescent lamp 16 is activated by a lamp driving circuit 17 (see FIG. 2).

The fluorescent lamp 16 comprises a sealed case 28 (see FIG. 3) having a parallelepiped shape, and is disposed so as to adjust a longitudinal direction thereof to a width direction (scanning direction) of the color thermosensitive recording paper 3. The flat-type fluorescent lamp 16 has a yellow luminescent surface 16*a* for emitting yellow fixing rays, and a magenta luminescent surface 16*b* for emitting magenta fixing rays. The magenta luminescent surface 16*b* is set on a plane different from the yellow luminescent surface 16*a*. The yellow luminescent surface 16*a* and the magenta luminescent surface 16*b* are disposed back to back with each other.

Figure 2:
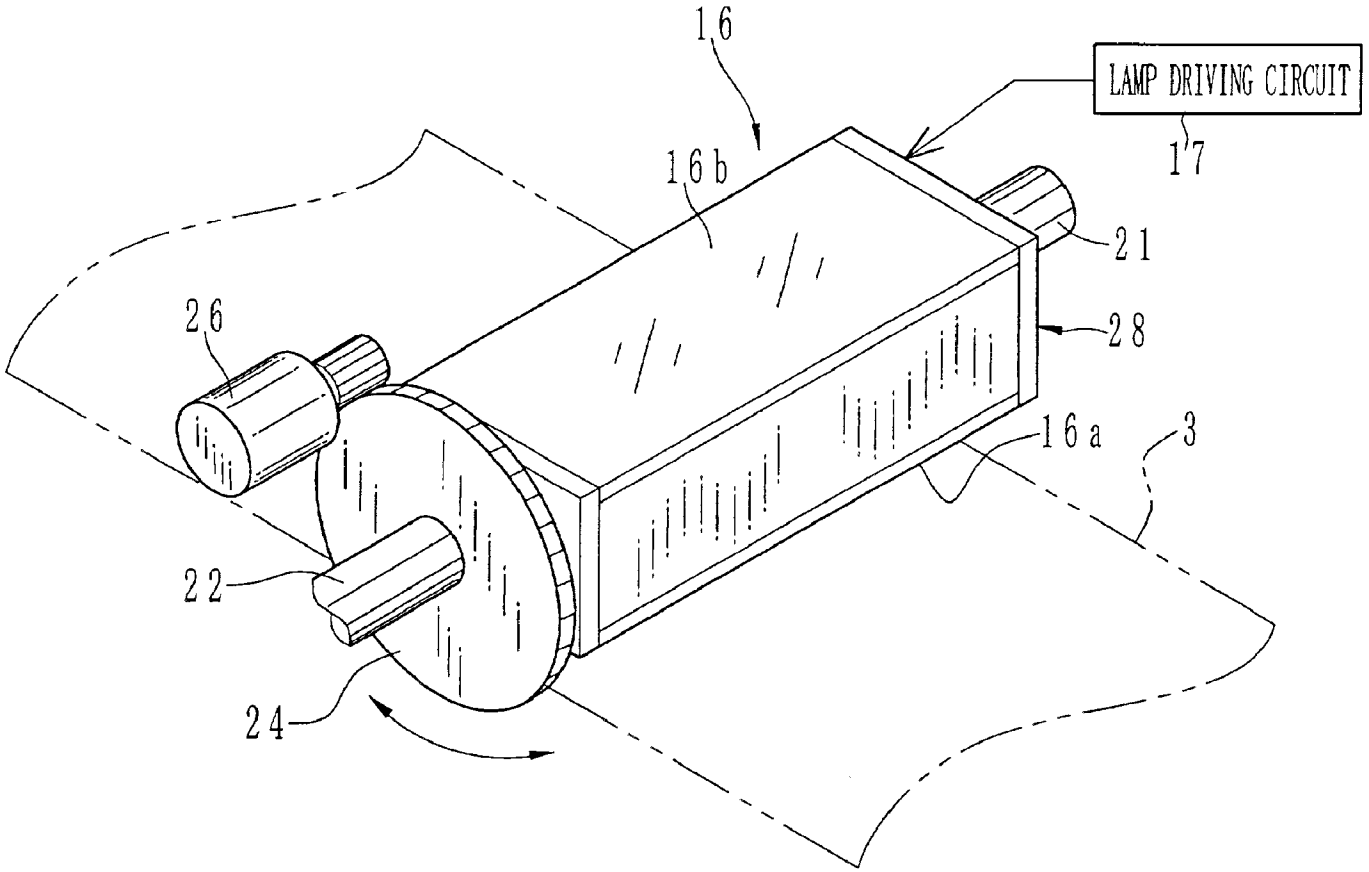
FIG. 2 is a perspective view showing an optical fixing unit.

As shown in FIG. 2, the flat-type fluorescent lamp 16 is provided with rotary shafts 21 and 22 disposed at both sides thereof. The fluorescent lamp 16 is rotatable between a yellow fixing position where the yellow luminescent surface 16*a* confronts a recording surface of the recording paper 3, and a magenta fixing position where the magenta luminescent surface 16*b* confronts the recording surface. By rotating the fluorescent lamp 16, the yellow and magenta luminescent surfaces 16*a* and 16*b* selectively confront the recording surface of the recording paper 3. An initial position is set to the yellow fixing position. In this way, the couple of the luminescent surfaces are disposed back to back with each other so that it is possible to shorten the conveyance passage in comparison with the color thermal printer having two fluorescent lamps disposed side by side.

A rotating mechanism comprises a drive gear 24 and a motor 26. The drive gear 24 is attached to the rotary shaft 22, and the motor 26 rotates the drive gear 24. A pulse motor is employed as the motor 26 so that a rotational amount of the fluorescent lamp 16 is controlled by counting drive pulses supplied to the pulse motor.

Figure 3:
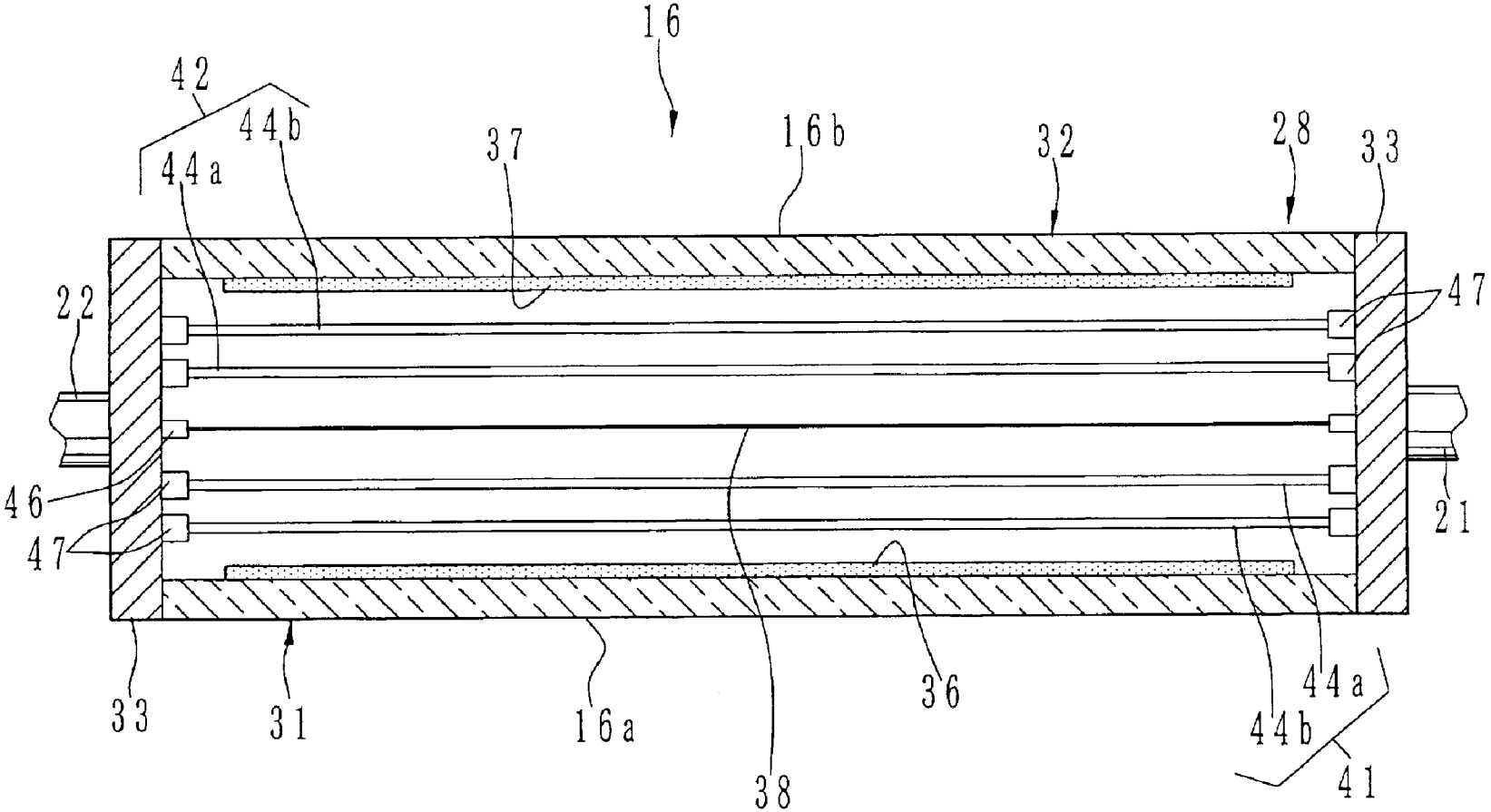
FIG. 3 is a section view showing a flat-type fluorescent lamp.

As shown in FIG. 3, the sealed case 28 of the fluorescent lamp 16 comprises retainer plates 33 to which a yellow anode panel 31, a magenta anode panel 32, and the rotary shafts 21 and 22 are attached. The retainer plates 33 hold the respective anode panels 31 and 32. The sealed case 28 further comprises a spacer, which constitutes a lateral side of the sealed case 28 and is disposed between the respective anode panels 31 and 32. The yellow anode panel 31 constitutes the yellow luminescent surface 16*a*. The magenta anode panel 32 constitutes the magenta luminescent surface 16*b*.

The yellow and magenta anode panels 31 and 32 are respectively formed from a transparent glass plate. As to the glass plate, is used quartz glass having not only high resistance to temperature but also high transmittance for the ultraviolet rays. Yellow fluorescent material 36 applied to an inner wall of the yellow anode panel 31 emits the yellow fixing rays of 420 to 450 nm, which is the optimum rays for fixing the yellow thermosensitive coloring layer. Meanwhile, magenta fluorescent material 37 applied to an inner wall of the magenta anode panel 32 emits the magenta fixing rays of 365 to 390 nm, which is the optimum rays for fixing the magenta thermosensitive coloring layer.

The middle of the sealed case 28 is provided with a filament (cathode) 38 for irradiating the electron beam. A yellow grid electrode 41 and a magenta grid electrode 42 are provided so as to be disposed between the filament 38 and the respective anode panels 31 and 32. Each of the yellow and magenta grid electrodes 41 and 42 comprises two electrode plates 44*a* and 44*b* having a mesh form. The filament 38 and the electrode plates 44*a* and 44*b* are retained by means of metal fittings 46 and 47 provided on the retainer plate 33. The filament 38 and the yellow and magenta grid electrodes 41 and 42 are connected to the lamp driving circuit 17 via the metal fittings 46, 47 and lead wires (not shown).

Upon applying a voltage to the filament 38, the electron beam radiates therefrom. The filament 38 is used in both cases of emitting the yellow fixing rays and emitting the magenta fixing rays. To the respective grid electrodes 41 and 42 of yellow and magenta, a voltage is selectively applied.

In other words, when the yellow fixing rays are emitted from the yellow luminescent surface 16*a*, the lamp driving circuit 17 applies the voltage to the yellow grid electrode 41. In doing so, the electron beam from the filament 38 is accelerated toward the yellow fluorescent material 36 by potential difference caused between the yellow anode panel 31 and the filament 38. And then, the electron beam collides with the yellow fluorescent material 36 so that the yellow fluorescent material 36 is excited to emit the light.

Meanwhile, when the magenta fixing rays are emitted from the magenta luminescent surface 16*b*, the voltage is applied to the magenta grid electrode 42. In doing so, the electron beam from the filament 38 is accelerated toward the magenta fluorescent material 37 by potential difference caused between the magenta anode panel 32 and the filament 38. And then, the electron beam collides with the magenta fluorescent material 37 so that the magenta fluorescent material 37 is excited to emit the light. Since the yellow luminescent surface 16*a* and the magenta luminescent surface 16*b* selectively emit the light, it is unnecessary to provide a light-shielding filter for shielding the magenta fixing rays at the time of yellow fixation. Owing to this, a body of the printer may be downsized. Moreover, the luminescent surfaces 16*a* and 16*b* are selectively activated so that it is prevented to waste the electric power used for emitting the light.

Hereinafter, an operation of the above structure is described. When the color thermal printer 2 carries out a printing operation, the recording paper roll 4 is set first, and then, the printing operation is instructed. Upon instruction for printing, the color thermosensitive recording paper 3 is fed to the conveyance passage. The thermal head 6 thermally records a yellow image on the yellow thermosensitive coloring layer. A thermally-recorded portion of the recording paper 3 is successively conveyed to the optical fixing unit 9.

When fixing the yellow image, the lamp driving circuit 17 applies the voltage to both of the filament 38 and the yellow grid electrode 41. Thus, the yellow fixing rays are emitted from the yellow luminescent surface 16*a* to optically fix the yellow thermosensitive coloring layer for which thermal recording has been performed.

After completing the thermal record of the yellow image and the optical fixation thereof, the color thermosensitive recording paper 3 is rewound. During the rewind of the recording paper 3, the motor 26 is activated to rotate the flat-type fluorescent lamp 16 and to set it to the magenta fixing position. After that, the color thermosensitive recording paper 3 is conveyed in the forward direction again to thermally record a magenta image.

When fixing the magenta image, the lamp driving circuit 17 applies the voltage to both of the filament 38 and the magenta grid electrode 42. Thus, the magenta fixing rays are emitted from the magenta luminescent surface 16*b* to optically fix the magenta thermosensitive coloring layer for which thermal recording has been performed. After completing the thermal record of the magenta image and the optical fixation thereof, the recording paper 3 is rewound and is conveyed in the forward direction again. During the conveyance in the forward direction, a cyan image is thermally recorded. After the cyan image has been thermally recorded, the recorded portion of the recording paper 3 is cut into a sheet to be discharged.

In the above embodiment, the flat-type fluorescent lamp is used as the flat light source. However, another flat light source may be used. For instance, as the other flat light source, there are a plasma display panel and a luminous-element array in which a large number of luminous elements are arranged. The luminous element is one of a light emitting diode, an electroluminescence, and so forth.

When the luminous-element array is used, yellow and magenta luminous-element arrays are respectively prepared to constitute the luminescent surfaces of yellow and magenta. These arrays are disposed back to back. In this case, two luminous-element arrays individually prepared may be disposed back to back. Alternatively, a component may be commonly used such that the yellow luminous elements are arranged on one surface of a single substrate, and the magenta luminous elements are arranged on the other surface thereof.

In the forgoing embodiment, the respective luminescent surfaces of yellow and magenta are arranged back to back, but this is not exclusive. For instance, the respective luminescent surfaces may be arranged so as to form a section thereof in a V-figure shape. Also in this case, it is possible to shorten the length in the conveyance direction in comparison with the case that the yellow and magenta luminescent surfaces are arranged on the same plane. Thus, a body of the printer may be downsized.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A color thermal printer using a color thermosensitive recording paper including at least first and second thermosensitive coloring layers stacked on a base in order and coloring in different colors, in which said first and second thermosensitive coloring layers are optically fixed after thermal recording by applying rays of a first wavelength band and a second wavelength band respectively, said color thermal printer comprising:

a flat light source for optically fixing said first and second thermosensitive coloring layers, said flat light source having first and second luminescent surfaces radiating the rays of the first wavelength band and the second wavelength band respectively;

a rotating mechanism for rotating said flat light source, said rotating mechanism selectively confronting one of said first and second luminescent surfaces with said color thermosensitive recording paper; and a driving circuit for selectively activating said first and second luminescent surfaces to emit the rays in order to emit the rays of the first wavelength band or the second wavelength band to said color thermosensitive recording paper.

2. A color thermal printer according to claim 1, wherein said flat light source is a flat-type fluorescent lamp comprising:

a first anode panel constituting said first luminescent surface;

a first fluorescent material applied on an inner wall of said first anode panel and excited by irradiation of an electron beam to emit the ray of the first wavelength band;

a second anode panel constituting said second luminescent surface;

a second fluorescent material applied on an inner wall of said second anode panel and excited by irradiation of the electron beam to emit the ray of the second wavelength band;

a filament for radiating the electron beam to said first and second fluorescent materials;

a first grid electrode disposed between said filament and said first anode panel, said first grid electrode controlling the electron beam to enter said first anode panel; and a second grid electrode disposed between said filament and said second anode panel, said second grid electrode controlling the electron beam to enter said second anode panel.

3. A color thermal printer according to claim 2, wherein said flat-type fluorescent lamp includes a sealed case having a parallelepiped shape, said first and second anode panels being disposed at facing two sides of said sealed case.

4. A color thermal printer according to claim 3, wherein said first and second anode panels are made of a transparent plate.

5. A color thermal printer according to claim 4, wherein said driving circuit applies voltages to said filament and one of said first and second grid electrodes.

6. A color thermal printer according to claim 5, wherein said filament is disposed at the middle of said sealed case.

7. A color thermal printer according to claim 6, wherein said first and second grid electrodes respectively comprise two electrode plates having a mesh form.

8. A color thermal printer according to claim 7, wherein said sealed case further comprises:

a pair of retainer plates constituting both ends of said sealed case; and a plurality of metal fittings provided on said retainer plates and for holding said filament and said grid electrodes.

9. A color thermal printer according to claim 8, wherein said filament and said grid electrodes are connected to said driving circuit via said metal fittings.

10. A color thermal printer according to claim 1, wherein said rotating mechanism comprises:

rotary shafts attached to both ends of said flat light source;

a drive gear attached to said rotary shaft; and a motor for rotating said drive gear.

11. A color thermal printer according to claim 10, wherein said motor is a pulse motor, and a rotational amount of said flat light source is controlled by counting drive pulses to be supplied to said pulse motor.

12. A color thermal printer according to claim 1, wherein said first wavelength band is from 420 nm to 450 nm and said second wavelength band is from 365 nm to 390 nm.

13. The color thermal printer according to claim 1, wherein said flat light source comprises a flat type fluorescent lamp.

14. The color thermal printer according to claim 1, wherein said flat light source comprises a filament as an electron source.

15. The color thermal printer according to claim 14, wherein said first luminescent surface comprises a first anode panel and said second luminescent surface comprises a second anode panel, said first and second anode panels each receiving the electrons of said filament.

16. The color thermal printer according to claim 14, wherein said first and second luminescent surfaces are arranged in a V-figure shape.

17. The color thermal printer according to claim 1, wherein said first luminescent surface comprises a first panel and said second luminescent surface comprises a second panel.

* * * * *